US008839735B2

(12) United States Patent
VanNimwegen et al.

(10) Patent No.: US 8,839,735 B2
(45) Date of Patent: Sep. 23, 2014

(54) KAYAK WITH REMOVABLE SEAT ELEMENTS

(71) Applicant: Lifetime Products, Inc., Clearfield, UT (US)

(72) Inventors: Edward VanNimwegen, North Ogden, UT (US); Brent Steed, Syracuse, UT (US); Tim Niemier, Bellingham, WA (US)

(73) Assignee: Lifetime Products, Inc., Clearfield, UT (US)

( * ) Notice: Subject to any disclaimer, the term of this patent is extended or adjusted under 35 U.S.C. 154(b) by 0 days.

(21) Appl. No.: 14/011,609

(22) Filed: Aug. 27, 2013

(65) Prior Publication Data

US 2013/0340669 A1 Dec. 26, 2013

Related U.S. Application Data

(63) Continuation of application No. 13/623,691, filed on Sep. 20, 2012.

(60) Provisional application No. 61/700,169, filed on Sep. 12, 2012, provisional application No. 61/537,919, filed on Sep. 22, 2011.

(51) Int. Cl.

| | |
|---|---|
| ***B63B 35/00*** | (2006.01) |
| ***B63B 35/73*** | (2006.01) |
| ***B63B 35/71*** | (2006.01) |
| ***B63B 17/00*** | (2006.01) |
| *B63B 13/00* | (2006.01) |

(52) U.S. Cl.

CPC ..... *B63B 17/00* (2013.01); *B63B 35/73* (2013.01); *B63B 35/71* (2013.01); *B63B 2035/715* (2013.01); *B63B 13/00* (2013.01)

USPC ..... 114/347; 114/363

(58) Field of Classification Search

USPC ..... 114/347, 363

See application file for complete search history.

(56) References Cited

U.S. PATENT DOCUMENTS

| | | | |
|---|---|---|---|
| 911,806 | A | 2/1909 | Broward |
| 2,079,871 | A | 5/1937 | Price |
| 2,126,106 | A | 8/1938 | Goildberg |

(Continued)

FOREIGN PATENT DOCUMENTS

| | | |
|---|---|---|
| JP | 61-169883 | 10/1986 |

OTHER PUBLICATIONS

Notice of Allowance dated Apr. 1, 2014 from U.S. Appl. No. 13/623,691, filed Sep. 20, 2012.

(Continued)

*Primary Examiner* — Lars A Olson
*Assistant Examiner* — Jovon Hayes
(74) *Attorney, Agent, or Firm* — Workman Nydegger

(57) ABSTRACT

In one example, a watercraft, such as a kayak, is provided that includes a body, at least a portion of the body having a unitary one-piece construction. The body includes a hull and a cockpit that is integral with the hull, and the cockpit includes a seating area. Finally, the example watercraft includes a backrest connected to the body near the seating area and rotatable between a substantially vertical orientation and a substantially horizontal orientation, and movement of the backrest is limited to rotational motion.

28 Claims, 8 Drawing Sheets

(56) References Cited

U.S. PATENT DOCUMENTS

| | | | | |
|---|---|---|---|---|
| 2,701,089 | A | 2/1955 | Fischer | |
| 3,343,659 | A | 9/1967 | Marondel | |
| 3,372,813 | A | 3/1968 | Ishida | |
| 3,387,325 | A | 6/1968 | Sonneborn et al. | |
| 3,860,305 | A | 1/1975 | Bergman | |
| 3,863,829 | A | 2/1975 | Merrill | |
| 4,066,032 | A | 1/1978 | Travis | |
| 4,229,850 | A | 10/1980 | Arcouette | |
| 4,483,380 | A | 11/1984 | Beran | |
| 4,556,003 | A | 12/1985 | Prade | |
| 4,589,365 | A | 5/1986 | Masters | |
| 4,660,490 | A | 4/1987 | Broadhurst | |
| 4,802,708 | A * | 2/1989 | Vos et al. | 297/252 |
| D308,662 | S | 6/1990 | Darby | |
| 5,042,416 | A | 8/1991 | Arcouette | |
| 5,061,215 | A | 10/1991 | Walls | |
| 5,131,875 | A | 7/1992 | Lee | |
| 5,356,201 | A * | 10/1994 | Olson | 297/352 |
| D352,266 | S | 11/1994 | Niemier | |
| D352,689 | S | 11/1994 | Niemier | |
| 5,377,607 | A | 1/1995 | Ross | |
| 5,397,525 | A | 3/1995 | Niemier | |
| 5,405,002 | A | 4/1995 | Troia | |
| 5,415,343 | A | 5/1995 | Vosbikian | |
| 5,425,325 | A | 6/1995 | Washio | |
| D364,139 | S | 11/1995 | Niemier | |
| 5,493,982 | A | 2/1996 | Carpenter et al. | |
| 5,573,115 | A | 11/1996 | Fuller | |
| D377,473 | S | 1/1997 | Niemier | |
| 5,662,505 | A | 9/1997 | Spriggs | |
| D390,527 | S | 2/1998 | Niemier | |
| D391,916 | S | 3/1998 | Masters | |
| D394,630 | S | 5/1998 | Lincoln | |
| 5,810,177 | A | 9/1998 | Cabiran | |
| D400,843 | S | 11/1998 | Niemier | |
| 5,842,566 | A | 12/1998 | White | |
| 5,964,177 | A | 10/1999 | Niemier | |
| 6,035,801 | A | 3/2000 | Addison | |
| 6,112,692 | A * | 9/2000 | Lekhtman | 114/347 |
| 6,132,267 | A | 10/2000 | Campbell | |
| 6,152,063 | A * | 11/2000 | Niemier | 114/347 |
| 6,178,912 | B1 * | 1/2001 | Niemier | 114/347 |
| 6,210,242 | B1 | 4/2001 | Howard et al. | |
| 6,289,838 | B2 | 9/2001 | Dust | |
| 6,315,177 | B1 | 11/2001 | Weatherall | |
| 6,325,014 | B1 | 12/2001 | Blanchard | |
| 6,427,842 | B1 | 8/2002 | Green | |
| 6,561,118 | B2 | 5/2003 | Mead | |
| 6,669,516 | B1 | 12/2003 | Husted et al. | |
| 6,681,968 | B2 | 1/2004 | Zwagerman | |
| 6,718,905 | B1 * | 4/2004 | Peerson et al. | 114/347 |
| 6,736,084 | B2 * | 5/2004 | McDonough et al. | 114/363 |
| 6,745,716 | B2 | 6/2004 | Belyeu | |
| 6,755,145 | B2 | 6/2004 | Bolebruch | |
| 6,837,378 | B2 | 1/2005 | Mason et al. | |
| 6,863,014 | B2 | 3/2005 | Hudson et al. | |
| 6,874,442 | B1 | 4/2005 | McDonough | |
| 6,880,481 | B2 * | 4/2005 | Dunn et al. | 114/347 |
| 6,923,137 | B2 | 8/2005 | Waits, Jr. | |
| 6,964,243 | B1 | 11/2005 | Thompson | |
| 6,990,920 | B2 * | 1/2006 | Hamilton et al. | 114/363 |
| 7,021,234 | B1 | 4/2006 | Belyeu | |
| 7,032,531 | B1 * | 4/2006 | Caples | 114/347 |
| D544,824 | S | 6/2007 | Eckert | |
| 7,320,291 | B2 * | 1/2008 | Eckert | 114/347 |
| 7,370,596 | B2 | 5/2008 | Warren | |
| 7,523,598 | B1 | 4/2009 | Eckert | |
| 7,735,442 | B2 | 6/2010 | Richter | |
| 7,887,381 | B2 | 2/2011 | Brass et al. | |
| 7,987,654 | B1 | 8/2011 | Eckert | |
| 2002/0109251 | A1 | 8/2002 | Sellepack | |
| 2002/0166493 | A1 | 11/2002 | Sorensen | |
| 2003/0003825 | A1 | 1/2003 | Keller | |
| 2003/0106835 | A1 | 6/2003 | Hubbs et al. | |
| 2004/0255828 | A1 | 12/2004 | Markling et al. | |
| 2006/0060125 | A1 | 3/2006 | Pentecost | |
| 2006/0254495 | A1 | 11/2006 | Eckert | |
| 2007/0017431 | A1 * | 1/2007 | Hopkins | 114/347 |
| 2008/0236471 | A1 | 10/2008 | Mott | |
| 2009/0038526 | A1 * | 2/2009 | Walton | 114/347 |
| 2009/0064917 | A1 * | 3/2009 | Mackereth | 114/363 |
| 2010/0009579 | A1 | 1/2010 | Wood | |
| 2012/0017821 | A1 * | 1/2012 | McDonough | 114/363 |
| 2013/0340669 | A1 * | 12/2013 | VanNimwegen et al. | 114/347 |

OTHER PUBLICATIONS

International Preliminary Report on Patentability dated Mar. 25, 2014 from International Patent Application No. PCT/US2012/056630 filed Sep. 21, 2012.
EMSCO Group, Voyager Family Recreation Kayak Marketing Brochure, Aug. 9, 2004 (2 pages).
Dragonfly Innovations,Moorea Marketing Brochure, Aug. 9, 2005 (1 page).
Emotion Kayaks—Fishing Kayaks, www.emotionkayaks.com/fishing-kayaks/, Jun. 18, 2012 (1 page).
Emotion Kayaks—Sit-On-Top Kayaks, www.emotionkayaks.com/sit-on-top/, Jun. 18, 2012 (1 page).
Emotion Kayaks—Parts, www.emotionkayaks.com/gear/parts.php, Jun. 18, 2012 (3 pages).
Emotion Kayaks—Sit Inside Kayaks, www.emotionkayaks.com/sit-inside/, Jun. 18, 2012.
International Search Report and Written Opinion dated Jan. 2, 2013 from International Patent Application No. PCT/US2012/056630 filed Sep. 21, 2012.
Notice of Allowance dated Jan. 15, 2009 from U.S. Appl. No. 11/688,361, filed Mar. 20, 2007.
Office Action dated Apr. 18, 2008 from U.S. Appl. No. 11/688,361, filed Mar. 20, 2007.
Notice of Allowance dated Feb. 1, 2011 from U.S. Appl. No. 12/431,613, filed Apr. 28, 2009.
Office Action dated Jul. 16, 2010 from U.S. Appl. No. 12/431,613, filed Apr. 28, 2009.
Office Action dated Mar. 18, 2008 from U.S. Appl. No. 11/591,184, filed Oct. 31, 2006.
Office Action dated Apr. 5, 2006 from U.S. Appl. No. 11/186,737, filed Jul. 21, 2005.
Office Action dated Apr. 4, 2011 from U.S. Appl. No. 12/538,645, filed Aug. 10, 2009.
Office Action dated May 26, 2011 from U.S. Appl. No. 12/538,822, filed Aug. 10, 2009.
Office Action dated Apr. 27, 2011 from U.S. Appl. No. 29/322,698, filed Aug. 8, 2008.
Office Action dated Aug. 20, 2010 from U.S. Appl. No. 29/322,698, filed Aug. 8, 2008.
Office Action dated Jul. 5, 2013 from U.S. Appl. No. 13/623,691, filed Sep. 20, 2012.
Office Action dated Jun. 6, 2013 from U.S. Appl. No. 13/195,703, filed Aug. 1, 2011.
Office Action dated Mar. 20, 2013 from U.S. Appl. No. 13/195,703, filed Aug. 1, 2011.
Notice of Allowance dated Aug. 23, 2013 from U.S. Appl. No. 13/195,703, filed Aug. 1, 2011.
Notice of Allowance dated Aug. 24, 2006 from U.S. Appl. No. 29/234,705, filed Jul. 21, 2005.
U.S. Appl. No. 11/186,737, filed Jul. 21, 2005.
U.S. Appl. No. 29/234,705, filed Jul. 21, 2005.
U.S. Appl. No. 29/322,698, filed Aug. 8, 2008.
U.S. Appl. No. 12/538,822, filed Aug. 10, 2009.
U.S. Appl. No. 12/538,645, filed Aug. 10, 2002.
U.S. Appl. No. 11/591,184, filed Oct. 31, 2006.
U.S. Appl. No. 13/195,703, filed Aug. 1, 2011.
U.S. Appl. No. 13/623,691, filed Sep. 20, 2012.

* cited by examiner

KAYAK WITH REMOVABLE SEAT ELEMENTS

RELATED APPLICATIONS

This application is a continuation of U.S. patent application Ser. No. 13/623,691, entitled KAYAK, filed Sep. 20, 2012 (the "'691 Application). The '691 Application, in turn, claims priority to: U.S. Provisional Patent Application Ser. No. 61/700,169, entitled KAYAK WITH MOVABLE SEAT ELEMENTS, filed Sep. 12, 2012; and, U.S. Provisional Patent Application Ser. No. 61/537,919, entitled KAYAK, filed Sep. 22, 2011. All of the aforementioned applications are incorporated herein in their respective entireties by this reference.

BACKGROUND OF THE INVENTION

At least some example embodiments of the invention concern kayaks. However, one or more of the concepts, in various combinations, disclosed herein may extend to other types of watercraft as well such as, for example, sailboats, surfboards, paipo boards, boards for wind surfers, paddleboards, knee boards, canoes, wakeboards, and body boards, examples of which include boards sometimes referred to as boogie boards.

ASPECTS OF SOME EXAMPLE EMBODIMENTS

The embodiments disclosed herein do not constitute an exhaustive summary of all possible embodiments, nor does the following discussion constitute an exhaustive list of all aspects of any particular embodiment(s). Rather, the following discussion simply presents selected aspects of some example embodiments. It should be noted that nothing herein should be construed as constituting an essential or indispensable element of any invention or embodiment. Rather, and as the person of ordinary skill in the art will readily appreciate, various aspects of the disclosed embodiments may be combined in a variety of ways so as to define yet further embodiments. Such further embodiments are considered as being within the scope of this disclosure. As well, none of the embodiments embraced within the scope of this disclosure should be construed as resolving, or being limited to the resolution of, any particular problem(s). Nor should such embodiments be construed to implement, or be limited to implementation of, any particular effect(s).

Disclosed embodiments are concerned with watercraft, one example of which is a kayak. Some example embodiments within the scope of this disclosure may, but need not, include one or more of the following elements, in any combination: a 'fish tail' configuration located at or near the back of the watercraft; a hull whose length is in a range of about 9 feet long to about 11 feet long; a hull whose length is about 10 feet long; a hull whose width is in a range of about 32 inches wide to about 40 inches wide; a hull whose width is about 36 inches; a hull whose thickness is in a range of about 6 inches to about 8 inches; a hull that is about 7 inches thick; one or more scuppers; one or more cup holders; paddle rests; a backrest; a removable backrest; a backrest attachment configuration that permits an associated backrest to move between a substantially upright position and a substantially folded position; a backrest attachment configuration that permits an associated backrest to move between, and be locked in, an upright position and a folded position; a backrest having a range of motion of about 90 degrees; a backrest having a range of motion of about 180 degrees; a rotatable backrest; a blow-molded plastic backrest; an injection-molded backrest; a backrest configured to be tilted at a desired angle relative to an associated watercraft or portion thereof; a backrest whose tilt angle is adjustable; means for retaining a backrest at a desired angle; means for retaining a backrest at a desired angle, wherein the means for retaining permits adjustments to the angle of the backrest; means for retaining a backrest at a desired angle, wherein the means comprises one or more elements of adjustable length that are connectible to the backrest and to structure of a watercraft; means for retaining a backrest at a desired angle, wherein the means comprises one or more adjustable seat straps that are removably connectible to one or both of the backrest and a watercraft; one or more adjustable seat straps that are removably connectible to one or both of a backrest and associated watercraft; multiple backrests in a single watercraft; a stop that may or may not be integrally formed with a watercraft, and the stop is configured and arranged to at least partly define a range of motion of an associated backrest; a hinge bracket connectible to a body of a personal watercraft and configured to releasably receive a corresponding portion of an associated backrest; a structure that may or may not be integrally formed with a watercraft, and the structure is configured to engage, possibly releasably, with corresponding structure of a movable backrest; a backrest configured to be connected to a watercraft with a hinge; a backrest having an integrally formed hinge portion; a hinge portion of a watercraft, the hinge portion configured to engage a corresponding hinge portion of a backrest; a hinge portion of a watercraft, the hinge portion configured to engage a corresponding hinge portion of a backrest in a snap fit or push fit arrangement; an attachment point that may or may not be integrally formed with a watercraft; one or more attachment points configured to engage, possibly releasably, a respective element that is connectible to a backrest; one or more tabs, slots and/or other retention elements that may or may not be integrally formed with a watercraft, and that releasably engage corresponding structure of a movable backrest so as to allow the movable backrest to be locked into one or more defined positions, which may optionally include one or both of a substantially vertical position and a substantially horizontal position; a swim step at or near the rear of the watercraft; a motor mount at or near the stern of the watercraft; a wheel mount at or near the stern of the watercraft; one or more handles; one, two, three, or more, seat backs; one or more drain plugs; a substantially flat bottom; a weight of about 55 pounds; a weight-carrying capacity of about 500 pounds; a fin-less construction; one or more seats and foot wells arranged such that a seat is positioned higher, relative to the bottom of the watercraft, than at least some of the foot wells; a cockpit and hull that are integrally molded together in a unitary one-piece construction; and, a seat located relatively close to the stern of the watercraft. A portion, or all, of the kayak may be constructed of blow-molded plastic and one or more of the aforementioned elements, in any combination, may be integrally formed as part of the kayak during a blow-molding process.

None of the foregoing elements should be interpreted to be an essential or critical element, and other embodiments may omit one or more of any of the foregoing elements while remaining within the scope of the invention. Moreover, the aforementioned elements may not be mutually exclusive and, as such, more than one of those elements could be included in a single embodiment. Correspondingly, various embodiments in the following list may be combined with each other.

In a first example embodiment, a watercraft is provided with a bottom that is configured to force water outwards, generally in a direction away from a centerline of the watercraft, as the watercraft moves forward through the water.

In a second example embodiment, a watercraft is provided that includes a fish tail configuration near the back of the watercraft.

In a third example embodiment, a watercraft is provided that includes a pair of curved surfaces that are located on the bottom of the watercraft and are spaced apart from each other at the back of the watercraft.

In a fourth example embodiment, a watercraft is provided that includes a fish tail configuration near the back of the watercraft, and the fish tail configuration is integrally formed with a hull of the watercraft.

In a fifth example embodiment, a watercraft is provided that includes a fish tail configuration near the back of the watercraft, and the fish tail configuration is integrally formed with another portion of the watercraft by one of a blow-molding, roto-molding, or twin-sheet process.

In a sixth example embodiment, a watercraft is provided that includes one or more scuppers that are integrally formed with another portion of the watercraft.

In a seventh example embodiment, a watercraft is provided that includes one or more scuppers that join a first portion of the watercraft with a second portion of the watercraft.

In an eighth example embodiment, a watercraft is provided that includes one or more scuppers implemented in the form of a tack-off.

In a ninth example embodiment, a watercraft is provided that includes a backrest attachment configuration that permits an associated backrest to move between an upright position and a folded position.

In a tenth example embodiment, a watercraft is provided that includes one or more seats and one or more foot wells, wherein one seat is positioned relatively higher than a foot well.

In an eleventh example embodiment, a watercraft is provided that includes a fish tail configuration that incorporates a swim step.

In a twelfth example embodiment, a watercraft is provided that includes a backrest that is rotatably connected to the watercraft.

In a thirteenth example embodiment, a watercraft is provided that includes a backrest that is detachably connected to the watercraft.

In a fourteenth example embodiment, a watercraft is provided that includes a backrest that is detachably, and rotatably, connected to the watercraft.

In a fifteenth example embodiment, a watercraft is provided that includes a backrest movably connected to the watercraft, and including means for retaining the backrest at a desired angle relative to the watercraft.

In a sixteenth example embodiment, a watercraft is provided that includes a backrest movably connected to the watercraft, and including means for retaining the backrest at a desired angle relative to the watercraft, where the means for retaining permits adjustments to the angle of the backrest relative to the watercraft.

In a seventeenth example embodiment, a watercraft is provided that includes a backrest movably connected to the watercraft, and including means for retaining the backrest at a desired angle relative to the watercraft, where the means comprises one or more elements of adjustable length that are connectible to the backrest and to the watercraft.

In an eighteenth example embodiment, a watercraft is provided that includes a backrest movably connected to the watercraft, and including means for retaining the backrest at a desired angle relative to the watercraft, where the means comprises one or more adjustable seat straps that are removably connectible to one or both of the backrest and the watercraft.

In a nineteenth example embodiment, a watercraft is provided that includes one or more backrests attached to the watercraft, possibly removably, by a hinge.

In a twentieth example embodiment, a watercraft is provided that includes a backrest that is detachably connected to the watercraft, and the backrest is an injection-molded element.

In any of the preceding example embodiments, the watercraft may be a kayak, although as noted elsewhere herein, the scope of this disclosure is not limited to kayaks.

Any embodiment of the watercraft, such as a kayak for example, that includes a hull and/or other portion which is constructed at least partly of blow-molded plastic may have an interior that is partly, or completely, hollow. Such embodiments may also include, disposed in the interior, one or more depressions, sometimes referred to as "tack-offs." In such embodiments, these tack-offs may be integrally formed as part of a unitary, one-piece structure during the blow-molding process. The depressions may extend from a first surface, such as a first interior surface of the hull, towards a second surface, such as a second interior surface of the hull. The ends of one or more depressions may contact or engage the second surface, or the ends of one or more of the depressions may be spaced apart from the second surface by a distance. In some instances, one or more depressions on a first interior surface may be substantially aligned with corresponding depressions on a second interior surface, and one or more depressions on the first interior surface may contact one or more corresponding depressions on the second interior surface or, alternatively, one or more depressions on the first interior surface may be spaced apart from corresponding depressions on the second interior surface. In still other instances, depressions that contact each other and depressions that are spaced apart from each other may both be present in a watercraft. The depressions may be sized and configured to strengthen and/or reinforce a portion of the watercraft such as, for example, the blow-molded plastic hull of a watercraft.

BRIEF DESCRIPTION OF THE DRAWINGS

The appended drawings contain figures of example embodiments to further illustrate and clarify various aspects of the present invention. It will be appreciated that these drawings depict only example embodiments of the invention and are not intended to limit its scope. Aspects of the invention will be described and explained with additional specificity and detail through the use of the accompanying drawings in which.

DETAILED DESCRIPTION OF SOME EXAMPLE EMBODIMENTS

Figure 1:
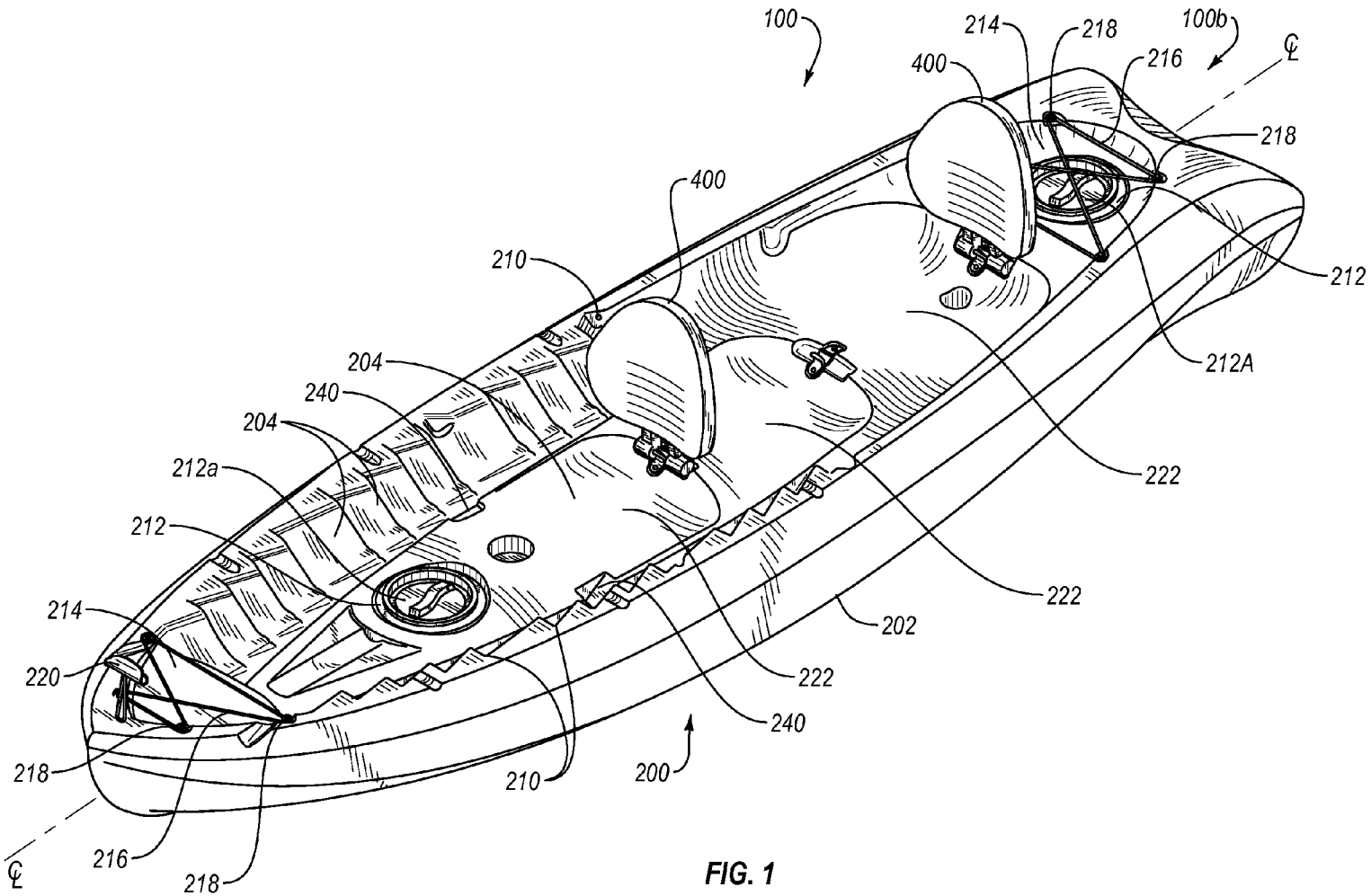
FIG. 1 is a top perspective view of an example of a kayak.

As noted elsewhere herein, at least some example embodiments of the invention concern kayaks. However, one or more of the concepts, in any combination, disclosed herein may extend to other types of watercraft as well such as, for example, sailboats, surfboards, paipo boards, boards for wind surfers, paddleboards, knee boards, canoes, wakeboards, and body boards, examples of which include boards referred to as boogie boards. Thus, the scope of this disclosure is not limited to kayaks, or to any other type(s) of watercraft.

A. General Aspects of Some Example Embodiments

While the discussion herein makes reference to a kayak, it should be understood that reference to a kayak is by way of illustration and the discussion applies as well to the various other types of watercraft disclosed herein, and to any other types of watercraft that would be apparent to a person of ordinary skill in the art.

In at least some embodiments, a portion, or all, of a watercraft such as a kayak may be constructed of blow-molded plastic. However, the scope of this disclosure is not limited to blow-molding processes or blow-molded elements. Other processes that may be used to construct a portion, or all, of a kayak, or other watercraft, include roto-molding, vacuum molding, and processes sometimes referred to as twin-sheet processes. It will also be appreciated that the kayak need not be constructed from plastic and may be constructed using other materials having other suitable characteristics.

Portions of a kayak that may be integrally formed as part of the kayak by way of a blow-molding process include, in any combination, one or more of: a fish tail configuration; a swim step; one or more projections on the hull; one or more recesses in the hull; one or more generally longitudinal recesses on the bottom of the hull; a cockpit; foot wells; backrest attachment; scuppers; stops for a backrest; and, one or more portions of a hinge for connecting to a backrest. Additionally, or alternatively, one or more other elements, in any combination, may be integrally formed with the kayak as part of a blow-molding process. Examples of such other elements include, but are not limited to, seats, hand holds, handles, foot wells, recesses of any type, storage areas, drain holes, paddle rests, and projections of any type.

Any of the embodiments disclosed herein, or derived from this disclosure, may also include a surface treatment, examples of which include ethylene-vinyl acetate (EVA) foam decking, ABS sheeting and polyethylene sheeting, disposed on at least a portion of the kayak, such as the swim step for example. Other surface treatments, such as texturing for example, may be formed as part of a blow-molding process. In one example of a surface treatment that may be included in any embodiment, the surface treatment may be configured to provide a grippable surface for a user so that the user can more readily grasp, and keep hold of, a portion of the kayak, such as the swim step for example. In another example that may be included in any embodiment, the hull and/or other portions of the kayak has one or more surfaces, such as on the swim step for example, with a chemically etched textured portion that provides traction and may allow for elastomeric sheathing to be adhered. In still further examples, one or more surfaces of the kayak are textured, and the sheathing or other covering may be omitted.

At least some embodiments of the kayak are tandem kayaks that are particularly well-suited for use by one, two, or more, adults, one or more of whom may be as tall as about 6'4." In one particular example, a kayak of about 9'6" to about 10'6" inches in length may be well-suited for use by such individuals, although other longer or shorter lengths may be employed as well. A kayak approximately 10 feet in length may, for example, have a width that is about 30 inches to about 40 inches, such as about 36 inches, and this example kayak may also have a thickness of about 6 inches to about 8 inches, such as about 7 inches. It should be understood that the length-to-width ratio, and other ratios, implicit in the foregoing example dimensions may be extended to define lengths, widths and/or thicknesses of other kayak embodiments. The aforementioned example kayak may have a weight-carrying capacity of about 450 lb. to about 550 lb., such as about 500 lb. for example, and this example kayak may weigh between about 50 lb. and about 60 lb., such as about 55 lb. for example. It should be understood that such weight capacities, and kayak weights, are examples only and other relationships of weight-carrying capacity and/or kayak weight relative to the length, width, and thickness of embodiments of the kayak are implicit in the aforementioned example and may be extended to define weight-carrying capacity and/or kayak weights of yet other kayak embodiments.

B. Description of Some Example Embodiments

Turning now to the Figures, details are provided concerning some example embodiments of a watercraft. With regard first to FIGS. 1-2*f*, a watercraft is indicated that, in this example, takes the form of a kayak 100, although the scope of the invention is not limited to kayaks. The kayak 100 has a bow 100*a* and a stern 100*b*, and includes a body 200 that, as noted elsewhere herein, may have a unitary single-piece construction formed by a blow-molding, or other, process. The body 200 may include, among other things, a hull 202, a cockpit 204, and one or more scuppers 206.

Figure 2A:
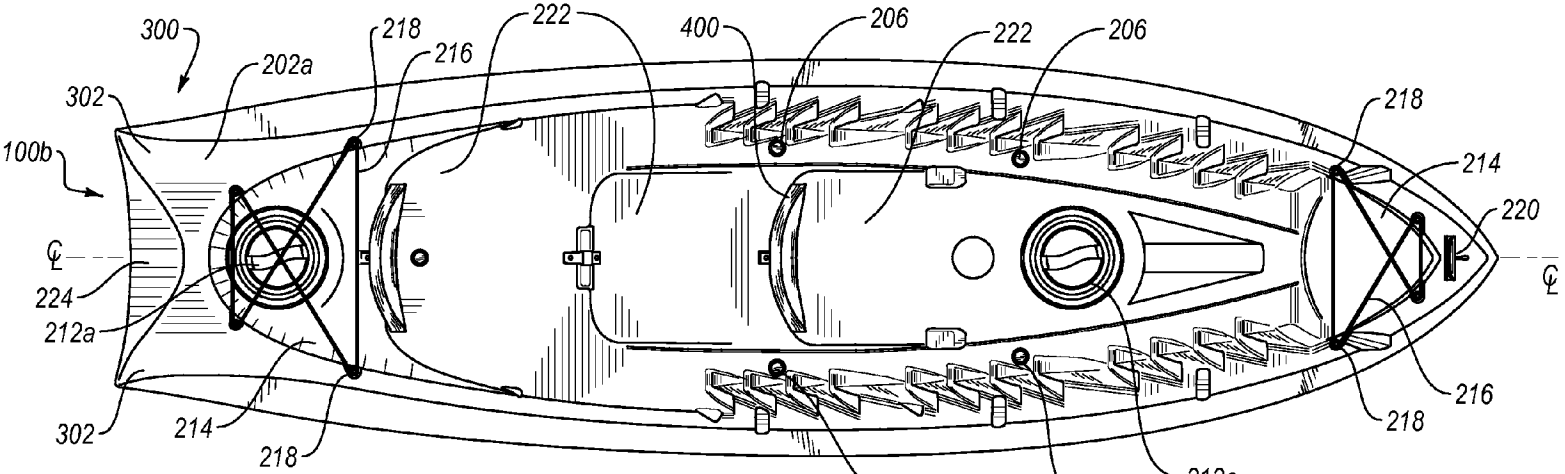
FIG. 2*a* is a top view of the example kayak shown in FIG. 1.
Figure 2B:
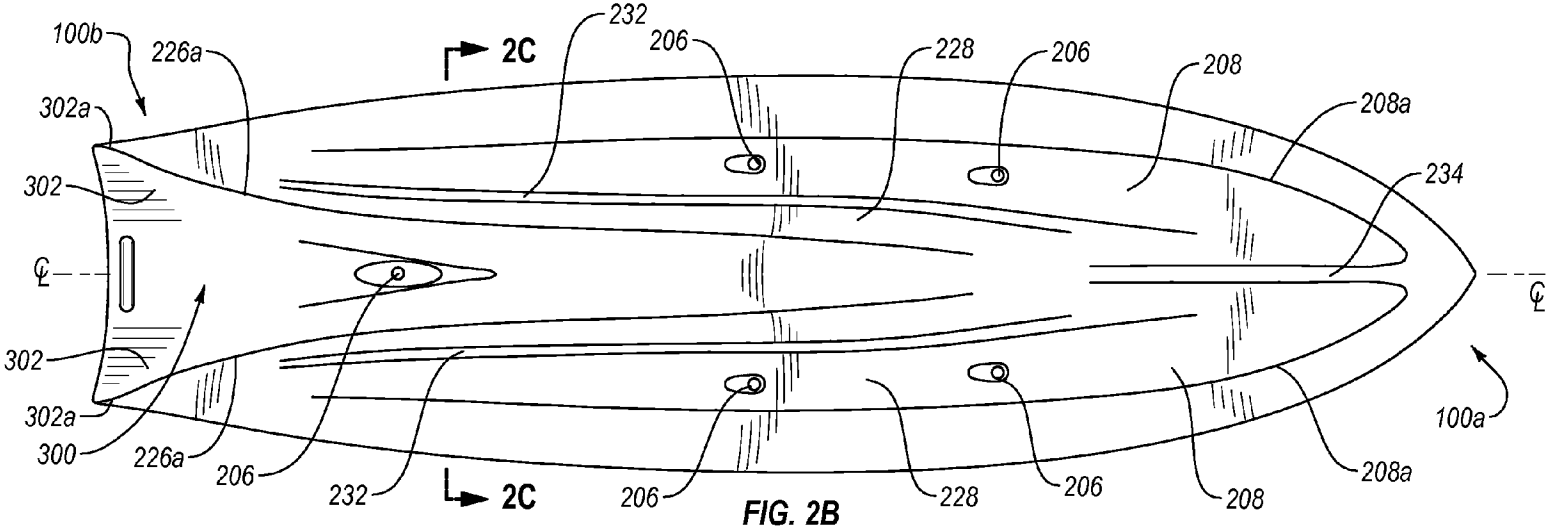
FIG. 2*b* is a bottom view of the example kayak shown in FIG. 1.
Figure 2C:
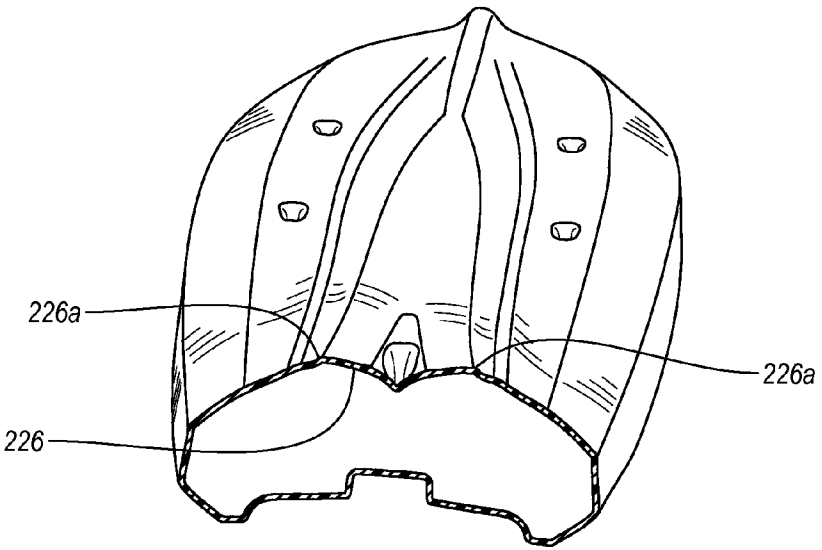
FIG. 2*c* is a partial cross-section view of the example kayak shown in FIG. 1.
Figure 2D:
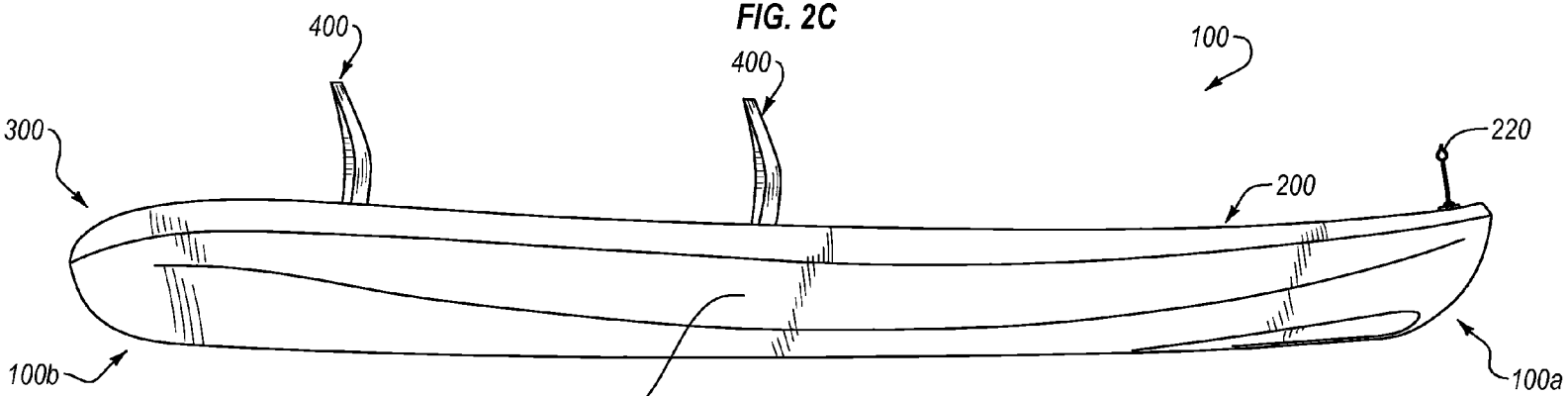
FIG. 2*d* is a side view of the example kayak shown in FIG. 1.
Figure 2E:
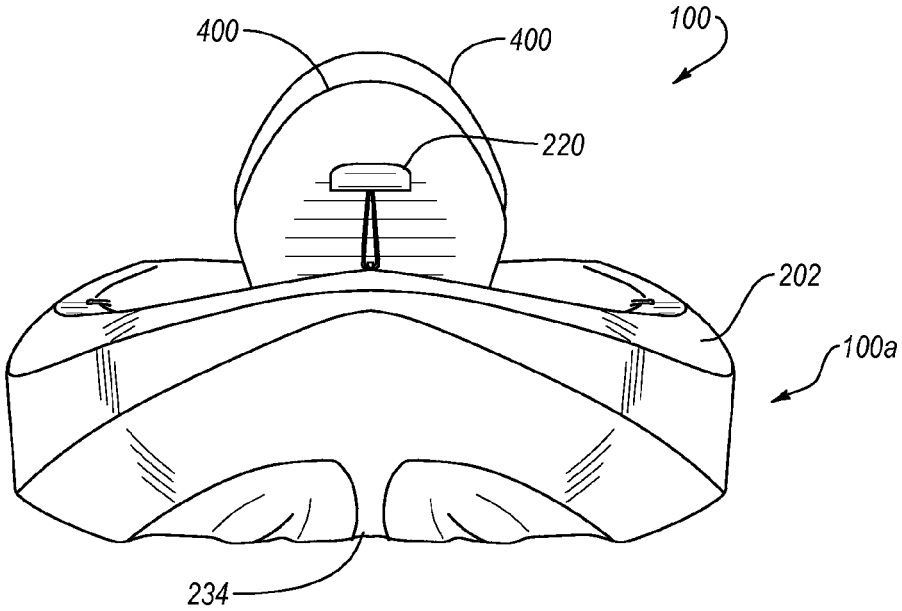
FIG. 2*e* is a front view of the example kayak shown in FIG. 1.

In the example of FIGS. 1, 2*a* and 2*b*, five scuppers 206 are provided, although more or fewer scuppers may be employed in other embodiments. The scuppers 206 may all be the same general configuration, or scuppers 206 of different configurations may be combined in a single embodiment. In the illustrated example, the scuppers 206 are generally circular in shape, although scuppers of other shapes, sizes and locations may be employed. In at least some embodiments, one or more of the scuppers 206 take the form of a tack-off formed by a blow-molding process that is used to integrally form the cockpit 204 with the hull 202. In addition to facilitating drainage of the cockpit 204, or at least providing low points for collecting water to be removed later, the scuppers 206 may also add strength and rigidity where the cockpit 204 joins the hull 202. In the example of FIG. 2, the scuppers 206 are generally located within recesses 208 that extend along the bottom of the hull 202. In at least some embodiments, the location of the scuppers 206 in the recesses 208 may lend particular strength and rigidity to the hull 202 and cockpit 204. In other embodiments, some, none, or all of the scuppers may be located other than within such recesses.

With continued reference to FIGS. 1 and 2*a*, some embodiments of the kayak 100 may include one or more foot wells 210 on either side of the cockpit 204. In general, the foot wells 210 may be configured and arranged to provide support for the feet of a user. In some embodiments, the foot wells 210 may be integrally formed with the body 200. Aspects such as the size, geometry, orientation, number, location and spacing of the foot wells 210 can be selected as desired. Among other things, the foot wells 210 may enable a user to position his or her feet in a variety of different locations within the cockpit 204. This flexibility in positioning may prove useful where considerations such as physical size and paddling style can vary from one user to another. As well, different water, wind and other environmental conditions may dictate changes in the foot position of a user.

As noted earlier, embodiments of the kayak 100 may have one, two, or more, seats. One or more of the seats 222, discussed in more detail below, may be positioned relatively higher in the kayak 100 than the foot wells 210. This configuration and arrangement of the seats 222 and foot wells 210 may provide relatively more comfortable sitting and paddling positions for the user, while reducing, or possibly eliminating, the need for backrests in some embodiments. Another aspect of the seat 222 and foot well 210 configuration and arrangement is that one or more relatively tall, e.g., greater than 6', individuals may be easily accommodated in, and operate, the kayak 100, even if the kayak 100 is as short as about 10' long.

Another useful aspect of some embodiments of the kayak relates to the compactness of certain configurations, such as tandem configurations for example. That is, such compactness tends to put the paddlers so close to each other that their legs would come into contact with the seat straps that connect from the front of the seat back to an area on the outer edge of the foot well trough. Some embodiments, one example of which is discussed herein in connection with FIG. 4, have eliminated this problem by mounting the seat straps to the outer edge of the seat bottom. This allows the paddler in the rear or middle position to straddle the seat strap in front of them without interference from the seat straps.

Some embodiments of the kayak 100 may include one or more internal storage areas 212 in the interior of the body 200 and accessible by way of a removable cover 212*a*, which may be threaded or otherwise configured to releasably engage corresponding structure of the body 200. Moreover, embodiments of the kayak 100 may include one or more stowage areas 214 where cargo can be secured, for example, by way of retention devices 216 such as elastic cords or other elements releasably connected to attachment points 218. At least some embodiments of the kayak 100 may include a handle 220 to enable a user to pull and otherwise maneuver the kayak 100. As noted above, embodiments of the kayak 100 may also include one or more seats 222.

In the particular example of FIG. 1, three seats 222 are provided, although more or fewer seats may be provided in other embodiments. In some embodiments, the seats 222 may be integrally formed with the body 200. One or more of the seats 222 may be sized and oriented to accommodate an adult passenger. Further examples of elements that may be employed in embodiments of the kayak 100 are disclosed elsewhere herein in connection with the discussion of backrests that may be employed in connection with the seats 222.

With particular reference to FIGS. 1, 2*a*, 2*b*, 2*d* and 2*f*, the kayak 100 may incorporate a 'fish tail' configuration 300. In at least some embodiments, some or all of the fish tail configuration 300 may be integrally formed with the rest of the kayak 100 in a blow-molding, or other, process that produces a kayak 100 having a unitary one-piece construction. As indicated in FIGS. 2*a* and 2*b*, the fish tail configuration 300 may include a pair of tail portions 302 that may collectively define a fork shape. The fork may be relatively shallow, as in the example of FIGS. 2*a* and 2*b*, or may be relatively deep. In one alternative embodiment, a portion of the fish tail configuration may be eliminated such that the back of the kayak 100 is relatively straight, rather than forked.

The outer edge 302*a* of each tail portion 302 may extend straight back, i.e., substantially parallel to the centerline CL, or may flare outward. In some embodiments, each of the tail portions 302 may include a recess 302*b* that extends partway along a length of the projection 302. These recesses 302*b* may facilitate drainage of water away from the upper surface 202*a* of the hull 202.

Figure 2F:
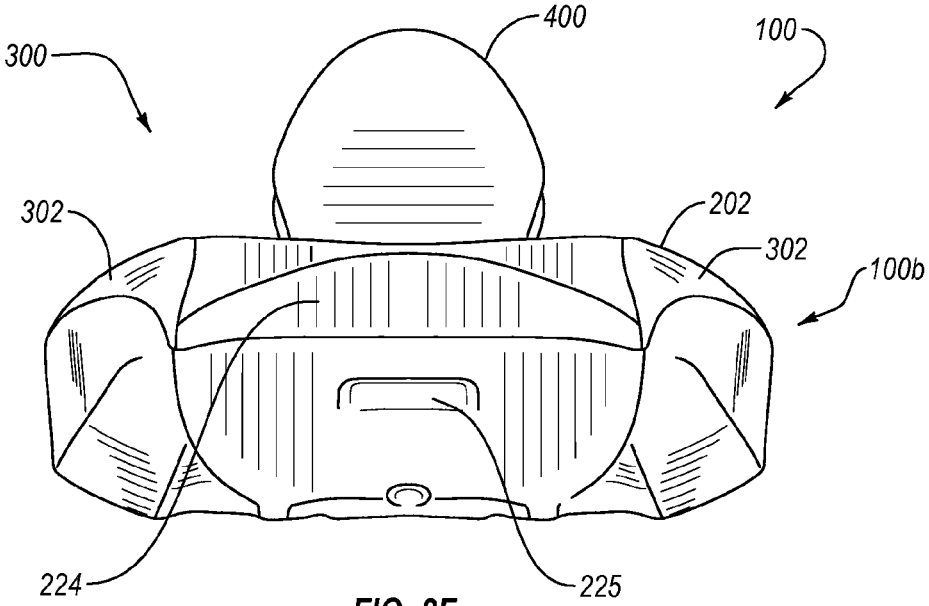
FIG. 2*f* is a rear view of the example kayak shown in FIG. 1.

With particular reference to FIG. 1, a swim step 224 may be positioned between the two tail portions 302. Among other things, the swim step 224 may slope downward and away from the upper surface 202*a* of the hull 202 so as to enable a user to readily reenter the kayak 100, such as by placing a foot and/or knee on the swim step 224. As noted elsewhere herein, the swim step 224 may be textured and/or covered in such a way as to provide a non-slip surface, or at least a surface that resists slippage of a user off of the swim step 224. Finally, the swim step 224 may be configured to accommodate accessories such as a wheel or an electric trolling motor. To this end, the swim step 224 may include one or more scuppers. As best shown in FIG. 2*f*, the body 200 may include one or more handles, such as handle 225, which may or may not be integrally formed with the body 200.

With continued reference to FIGS. 1 and 2, further details are provided concerning aspects of the example fish tail configuration 300. As particularly indicated in FIG. 2, the bottom of the body 200 may include a central recessed portion 226 bounded on a portion of each side by a knuckle 226*a* extending along at least a portion of a length of the body 200. In general, the term 'knuckle' embraces, but is not necessarily limited to, an angle defined by the intersection of two surfaces. The knuckles 226*a* diverge from each other proximate the stern 100*b* of the kayak 100 so as to collectively define a portion of the fish tail configuration 300. In particular, the tail portions 302 may be defined in part by and/or include portions of the knuckles 226*a*. The thickness of the hull 202 may be reduced near the tail portions 302 so as to at least partially define a depth and length of each of the tail portions 302. Thus configured, the tail portions 302 may extend vertically downward away from the upper surface 202*a* of the hull 202. The bottom of the hull 202 may also include first and second recesses 214 positioned outboard of a respective knuckle 226*a*. The recesses 214 may cooperate with recesses 208 to at least partly define a generally V-shaped portion 230 extending toward the bow 100*a*. In some embodiments, the recesses 208 and/or 214 may be implemented as, or incorporate, one or more tack-offs. More generally, any recess disclosed herein may be implemented as, or incorporate, one or more tack-offs.

As best indicated in FIG. 2*b*, some embodiments of the kayak 100 may be configured to include on or more ribs on the bottom of the body 200. Aspects such as the size, shape, number, location and orientation of the ribs may be varied as necessary, and the scope of the invention is not limited to the illustrated example embodiments.

With reference to the particular example of FIG. 2*b*, the kayak 100 may include ribs 232 that extend along a portion of the body 200. In this example, the ribs 232 are positioned between recess 208 and the central recessed portion 226, although other arrangements and numbers of ribs may alternatively be employed.

In addition, or as an alternative, to ribs 232, embodiments of the kayak 100 may include a rib 234 positioned proximate the centerline CL of the kayak 100. The rib 234 may begin proximate, or at, the bow 100*a* of the kayak 100, and may extend toward the stern 100*b*. The rib 234 may cooperate with knuckles 208*a* to at least partly define a portion of the recesses 208. In the example of FIG. 2*b*, the aft-most portion of rib 234 may be located proximate the forward-most portion of one or more of the V-shaped portion 230, the ribs 232, and the central recessed portion 226.

The example fish tail configuration 300 disclosed in the Figures may provide a variety of useful functions. For example, the configuration of the tail portions 302 may cause water to be pushed outward, in a direction away from the centerline CL, as the kayak 100 moves forward through the water. In this way, at least some embodiments of the kayak 100 are able to overcome the tendency of some known kayaks to wallow when paddled, insofar as those known kayaks are configured such that their hulls offer more resistance in the bow area than in the stern. Considered another way, the fish tail configuration 300 may provide for relatively lower resistance (i.e., through the water) in the front of the kayak 100 than in the rear by enabling the release of a smooth flow of water from the stern 100*b* which, in turn, contributes to speed and efficiency of paddling. Another consequence of this fish tail configuration 300 may be that when a user stops paddling, the kayak 100 continues to move in a relatively straight line. This may be particularly advantageous where the kayak is relatively short, e.g., about 10 feet long or shorter. A related advantage that may be realized with the fish tail configuration 300 is that because the kayak 100 tends to track in a straight line, even when not being paddled, the need for fins and similar guide elements may be avoided.

Another useful aspect that may attend use of the fish tail configuration 300 is improved stability of the kayak 100 owing to the flotation provided by the tail portions 302 near the outer edge of the hull 202, particularly near the stern 100*b*. Among other things, this improved stability may enable the rearmost seat 222 to be placed relatively further back than would be the case in a kayak having a conventional stern configuration.

As the foregoing makes clear, the fish tail configuration 300 is an example of a structural implementation of a means for performing, in any combination, one or more of: reducing hydrodynamic resistance at the bow of the kayak relative to the stern of the kayak; enabling the kayak to track in a relatively straight line, regardless of whether the kayak is being paddled or not; enhancing stability and/or flotation of the kayak near the stern of the kayak; enhancing the efficient flow of water off of and/or away from the stern of the kayak; enhancing lateral stability of the kayak.

Figure 3A:
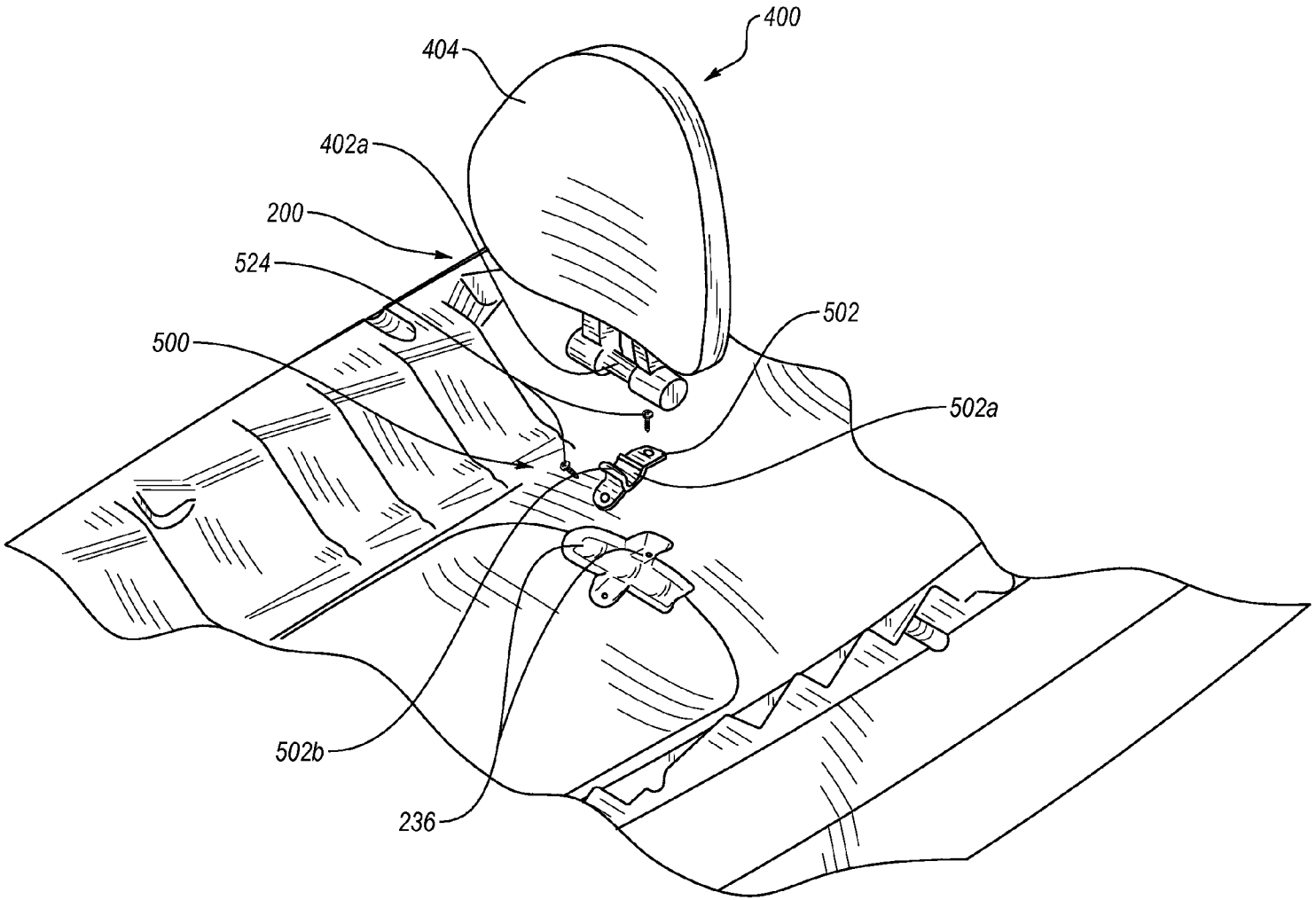
FIG. 3*a* is an exploded view of a kayak, such as the kayak of FIG. 1, that includes a removable backrest.
Figure 3B:
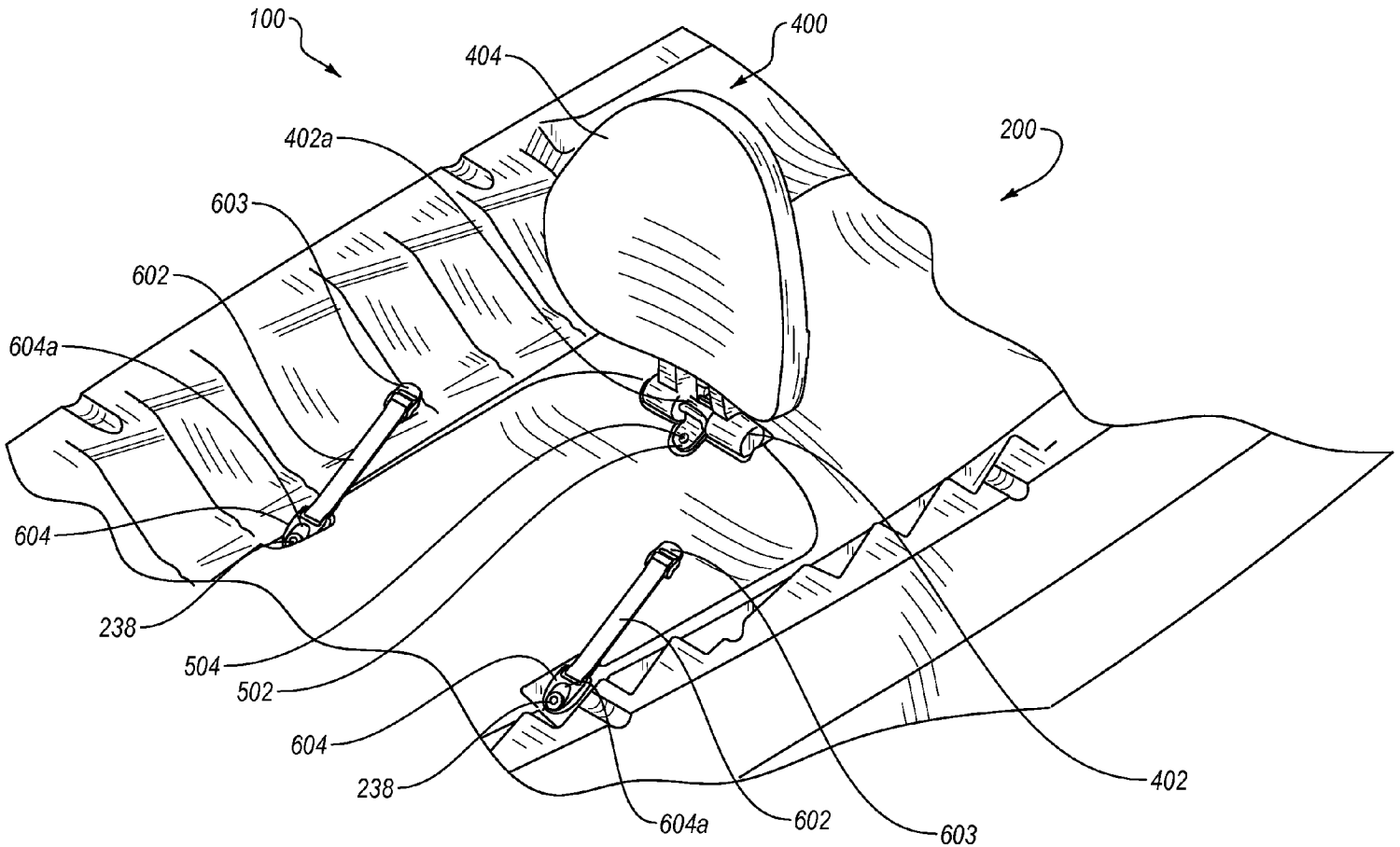
FIG. 3*b* is an assembled view of the backrest of FIG. 3*a;*
Figure 3C:
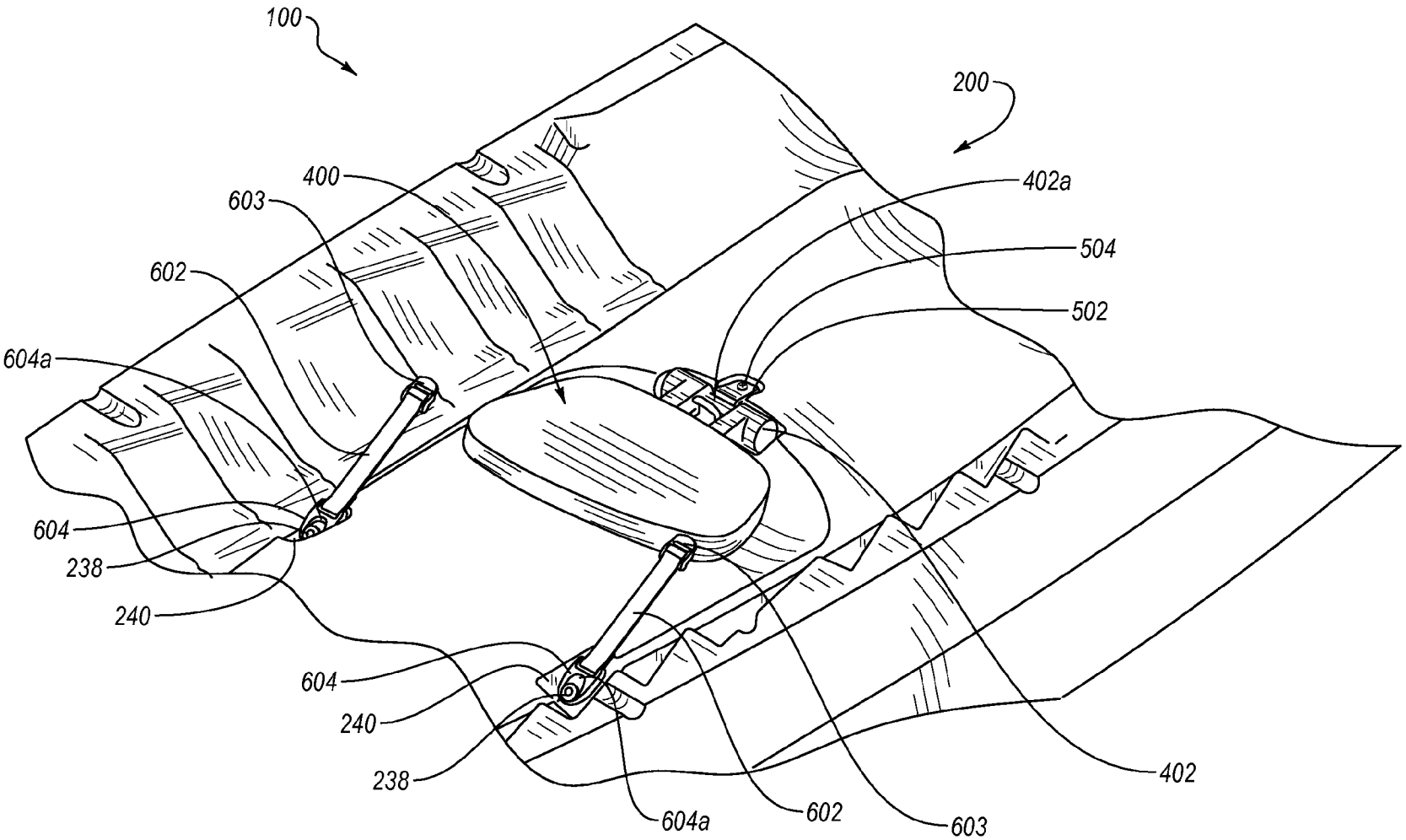
FIG. 3*c* is a partial perspective view indicating one example position of the backrest of FIGS. 3*a* and 3*b*.

With reference finally to FIGS. 3*a*-3*c*, at least some embodiments of a watercraft, such as a kayak for example, may include one or more backrests 400. At least one backrest may be releasably attachable to the watercraft, such that the backrest can be attached to, and detached from, the watercraft, as/if desired. As well, such a detachable backrest may be movable relative to the watercraft. A watercraft that includes, or is configured to include, one or more releasably attachable backrests may enable a user to readily customize the watercraft for different uses, and numbers and/or sizes of users.

Where multiple backrests are employed in a single watercraft, the backrests may be substantially the same as each other in terms of one or more of their size, shape, and/or configuration. However, the backrests need not be substantially the same as each other in any of the aforementioned regards.

Moreover, one or more backrests may, or may not, be interchangeable with one or more other backrests. This interchangeability may be implemented within a single type or model of watercraft, or across a plurality of types or models of watercraft.

In some instances, a backrest may be configured for use with a plurality of different types of watercraft, and need not necessarily be limited for use with a single type or model of watercraft. As well, a watercraft may be configured to accept only a single type of backrest configuration, or to accept a plurality of different backrest configurations.

One or more releasably attachable backrests, and one or more permanently attached, backrests may be combined together in a single watercraft. Alternatively, a watercraft may include only one or more releasably attachable backrests.

The backrest can be formed by any suitable process. Some examples include blow-molding, and injection-molding, although other processes can be employed as well. Thus, the backrest may comprise a blow-molded or injection-molded structure.

Turning now to some more particular aspects of an example backrest such as that disclosed in FIGS. 3*a*-3*c*, the backrest 400 may have any desired configuration and, in some example embodiments, may be substantially, or completely, constructed of blow-molded plastic. The backrest 400 may be shaped and configured to generally conform with the contours of a user's back. As well, the size and shape of the backrest 400 may generally conform with a recess defined by the seat 222 so that when the backrest 400 is folded down (see, e.g., FIG. 3*c*), some or all of the backrest 400 resides in the recess defined by the seat 222. Among other things, this configuration and arrangement may facilitate stacking of one or more kayaks 100.

As suggested above, the backrest 400 may be movable, such as by rotation, between one or more upright positions, one of which may be substantially vertical, and a folded position that may be substantially horizontal. The backrest 400 and/or the kayak 100 may be configured in any manner that permits the backrest 400 to move relative to the kayak 100. In one example embodiment, the backrest 400 may be connected, removably or permanently, to the kayak 100.

With reference now to the particular example of FIGS. 3*a*-3*c*, an embodiment is disclosed where a backrest 400 is configured to rotate, relative to the body 200, so as to be capable of assuming, at least, a substantially vertical position and a substantially horizontal position. The backrest 400 may, or may not, be removable from the body 200 of the kayak 100.

In one more particular example, the backrest 400 may be removably connected to the kayak 100 with an attachment mechanism, one example of which is hinge mechanism 500. The hinge mechanism 500 may include a hinge bracket 502 configured to be at least partly received in a corresponding recess 236 defined in the body 200 of the kayak 100. The hinge bracket 502 may be constructed of any suitable material, including plastic, or metals such as stainless steel, and the hinge bracket 502 may be secured to the body 200 with fasteners 504, such as screws for example. In one alternative configuration, the hinge bracket 502 may be constructed of plastic and integrally formed with the body 200, such as by blow-molding for example, or the hinge bracket 502 may be constructed of plastic and attached to the body 200 with one or more fasteners, which may or may not be plastic. As well, the hinge bracket 502 may be configured to receive, releasably in some embodiments, one or more corresponding structures of the seat 400.

More specifically, the hinge bracket 502 may define a channel 502*a* configured to receive a portion 402*a* of a hinge 402 of the backrest 400. The hinge 402 may be spaced apart from the body 404 by one or more supports 406. One or more of the hinge 402, body 404 and supports 406 may be integrally formed together to form the backrest 400, such as by blow-molding or injection molding, for example. The hinge 402 may be sized and configured to be snap-fit or push-fit into the channel 502*a* of the hinge bracket 502. For example, the width of the top of the channel 502*a* may be relatively smaller than the diameter of the portion 402*a* such that the portion 402*a* temporarily deforms, such as by widening, the top of the channel 502*a* as the portion 402*a* is pushed down into, or pulled out of, the channel 502*a*. An upper edge 502*b* of the channel 502*a* may be flared outward so as to guide the insertion of the portion 402*a* into the channel 502*a*.

Once the portion 402*a* has been positioned in the channel 502*a*, the backrest 400 may be rotatable relative to the body 200. In some embodiments, the backrest 400 and/or hinge mechanism 500 may be configured such that the backrest 400 may have a rotational range of motion of about 180 degrees, that is, from a position where the backrest 400 is folded forward as shown in FIG. 3*c*, to a position where the backrest 400 is folded back (not shown). In another example embodiment, the backrest 400 and/or hinge mechanism 500 may be configured such that the backrest 400 may have a rotational range of motion of about 90 degrees, that is, from a position where the backrest 400 is folded forward as shown in FIG. 3*c*, to a substantially vertical position as shown in FIG. 3*b*. These ranges of motion of the backrest 400 are presented only by way of example, and larger or smaller ranges of motion may be employed.

As will be evident from the present disclosure, the hinge mechanism 500 is but one example of a structural implementation of a means for releasably attaching a seat element, one example of such a seat element being a backrest, such as backrest 400 for example. Any other mechanism(s) having functionality comparable to that of the hinge mechanism may alternatively be employed in the releasable attachment of the backrest to a watercraft. For example, in one alternative embodiment, one or more fasteners, such as bolts or screws for example, may be used to releasably attach a backrest to a watercraft. The bolts or screws may be made of any material (s), including plastic, and may engage corresponding threads in the body of the watercraft. As another example, one or more quick-release mechanisms, such as a cam-lock mechanism for example, may be used to releasably attach a backrest to a watercraft. As a further example, devices such as pins may be used to releasably attach a backrest to a watercraft.

Figure 4:
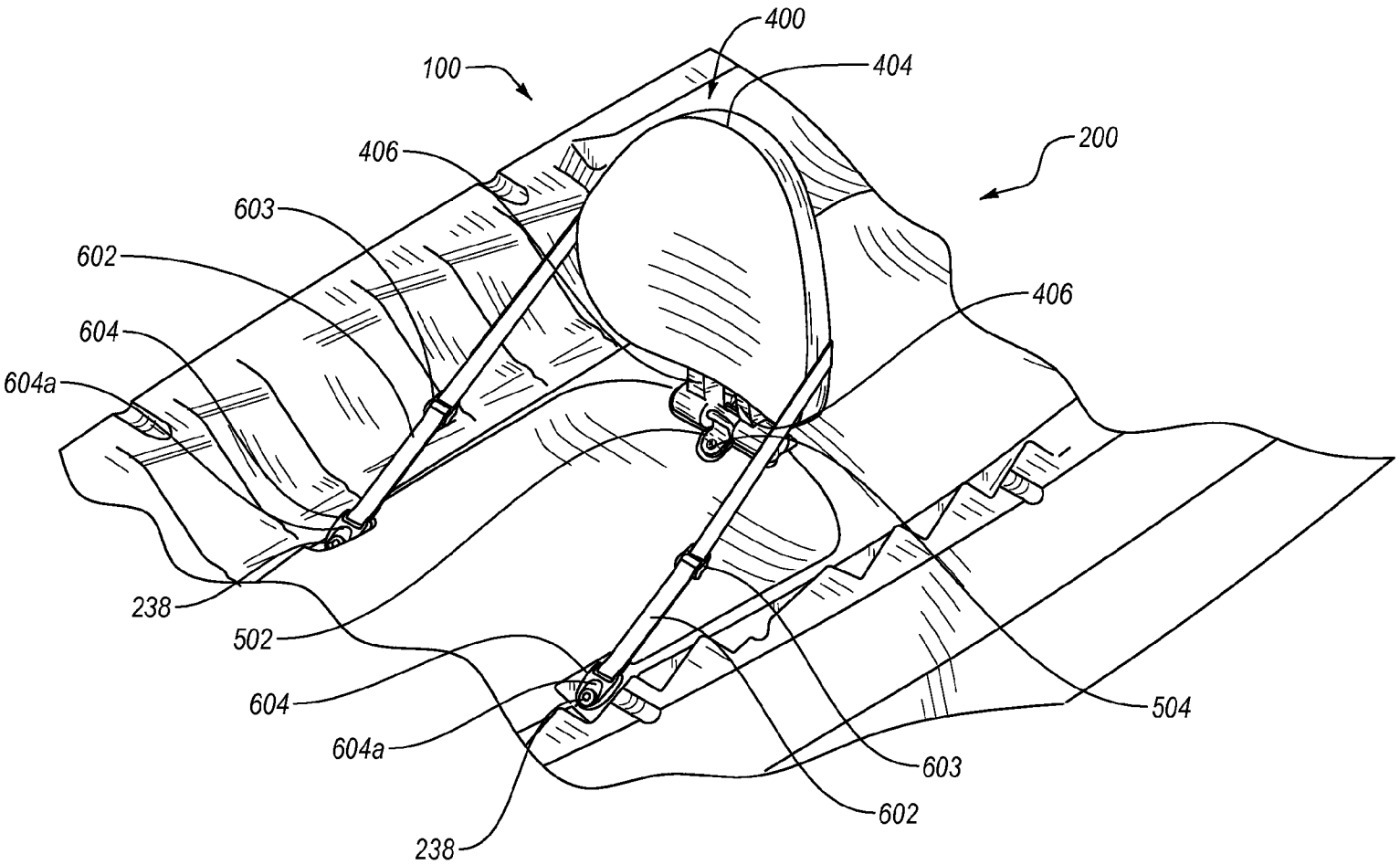
FIG. 4 is a detail view showing attachment of an example seat strap to an example backrest and body of a kayak such as the kayak shown in FIG. 1.

With reference now to FIG. 4, and continuing reference to FIGS. 3*b* and 3*c*, some embodiments may include one or more seat straps 602 whose length may or may not be adjustable. The seat straps 602 may or may not be employed for each backrest in a particular watercraft, and the seat straps 602 may be employed in different configurations depending upon considerations such as the intended use or configuration of a particular watercraft. Thus, in one example embodiment, the seat straps 602 for the front two seat positions in a watercraft may attach to the seat bottom, such as seat 222 (see, e.g., FIG. 1) instead of the outside gunwales so the seat straps 602 will not interfere with the feet of the kayaker in the seat behind.

The seat straps 602 may comprise, for example, nylon webbing or other suitable material(s). The seat strap 602 material may be wind, sun and/or water resistant. Further, the seat strap 602 material may be at least slightly elastic to permit the seat straps 602 to stretch to a desired extent. As well, the seat straps 602 may include adjustment elements 603 or other devices that permit adjustments to be made to the overall length of the seat strap 602. In other embodiments, the length of the seat straps 602 may be substantially fixed.

The seat straps 602 may include a connector 604 at one end of the seat strap 602 and configured to attach, permanently or releasably, to the kayak 100 or other watercraft. In the example of FIG. 6, the connector 604 may define an opening 604*a* configured to slip over and engage an attachment point 238 of the kayak 100 or other watercraft. The attachment point 238 may or may not be integrally formed with the kayak 100 or other watercraft. In some instances, the attachment point 238 is a structure that is discrete from, but connected to, the watercraft.

Where the attachment point 238 is configured, for example, generally in the shape of a pin, a first part of the opening 604*a* may have a diameter or width slightly larger than an upper portion of the attachment point 238, while a second part of the opening 604*a* may have a diameter or width smaller than that of the first part and slightly larger than a lower portion of the attachment point 238. In this example configuration, as tension is exerted on the seat strap 602, the lower portion of the attachment point 238 slides into the second part of the opening 604*a*.

The backrest 400 may include one or more attachment points (not shown), on the side or back of the backrest 400 for example, similar in construction to the attachment points 238, and configured to releasably engage a connector, such as connector 604 for example, located at an end of one or more seat straps 602. The backrest 400 attachment point(s) may or may not be integrally formed with the backrest 400.

As indicated in FIG. 3*b* (as well as FIG. 1), some embodiments of the body 200 may include one or more cutouts 240 that may be integrally formed with the body 200. Among other things, the cutouts 240 may enable the attachment points 238 and seat straps 602 to be located sufficiently far inboard so as not to substantially impede placement of the legs and feet of a user seated aft of seat 404 (FIG. 3*b*). Such an arrangement may be particularly useful for embodiments of the kayak that are relatively short, as that arrangement may enable a plurality of adult users to be seated in the kayak, notwithstanding the relatively short length of the kayak.

The present invention may be embodied in other specific forms without departing from its spirit or essential characteristics. The described embodiments are to be considered in all respects only as illustrative and not restrictive. All changes which come within the meaning and range of equivalency of the claims are to be embraced within their scope.

What is claimed is:

1. A watercraft, comprising:

a body, part of which is in the form of a unitary one-piece construction that defines a recess, and the body including:

a hull; and a cockpit that is integral with the hull, the cockpit including a seat that is located proximate the recess defined by the body; and a backrest including a hinge that is removably received in the recess defined by the body, the backrest being rotatable between a substantially vertical orientation and a substantially horizontal orientation.

2. The watercraft as recited in claim 1, wherein movement of the backrest is limited to rotational motion when the backrest is connected to the body.

3. The watercraft as recited in claim 1, wherein at least a portion of the body comprises blow-molded plastic.

4. The watercraft as recited in claim 1, wherein the body comprises one or more tack offs.

5. The watercraft as recited in claim 1, wherein the backrest is connected directly to the body.

6. The watercraft as recited in claim 1, wherein the backrest comprises a unitary one-piece construction.

7. The watercraft as recited in claim 1, further comprising a seat strap connectible directly to the backrest and to the body.

8. A kayak, comprising:

a body, part of which is in the form of a unitary one-piece construction that is substantially hollow and defines a recess, and the body including:

a hull; and a cockpit that is integral with the hull, the cockpit including a seat that is located proximate the recess defined by the body;

a hinge bracket at least partly received in the recess defined by the body; and a backrest including a hinge that is removably received in the hinge bracket, the backrest being rotatable between a substantially vertical orientation and a substantially horizontal orientation.

9. The kayak as recited in claim 8, wherein the body substantially comprises plastic and includes one or more tack offs.

10. The kayak as recited in claim 8, wherein the cockpit includes a total of three seats, and an aft-most seat is relatively wider than the other two seats.

11. The kayak as recited in claim 8, wherein the backrest is lockable in the substantially vertical orientation and in the substantially horizontal orientation.

12. The kayak as recited in claim 8, further comprising a pair of foot wells associated with the seat, each foot well being disposed on a respective opposing side of the cockpit, and wherein the foot wells are positioned lower in the cockpit, relative to an upper surface of the kayak, than the seat.

13. The kayak as recited in claim 8, wherein the body comprises a sit-on-top configuration.

14. A kayak, comprising:

a body, part of which is in the form of a unitary one-piece construction that is substantially hollow and defines a first part of a hinge mechanism, and the body including:

a hull; and a cockpit that is integral with the hull, the cockpit including an integral seat and a set of integral foot wells on each side of the cockpit;

a backrest connected to the body proximate the seat and movable between a substantially vertical orientation and a substantially horizontal orientation, wherein the backrest defines a second part of the hinge mechanism, and wherein the first part of the hinge mechanism defined by the body is engaged with the second part of the hinge mechanism defined by the backrest so as to enable rotation of the backrest; and first and second seat straps, each seat strap having a first end releasably connectible to the backrest and a second end releasably connectible to a bottom of the cockpit at a location inboard of the foot wells.

15. The kayak as recited in claim 14, wherein the hinge mechanism confines movement of the backrest to rotational motion.

16. The kayak as recited in claim 14, wherein the backrest is detachable from the body of the kayak.

17. The kayak as recited in claim 14, further comprising one of a wheel mount or a swim step located proximate a stern of the kayak.

18. The kayak as recited in claim 14, wherein the backrest is attachable to the body with a snap fit or push fit configuration.

19. The kayak as recited in claim 14, wherein the kayak is stackable with a kayak of substantially similar configuration without necessitating removal of the backrest.

20. A kayak, comprising:

a body, part of which is in the form of a unitary one-piece construction that is substantially hollow, and the body including:

a hull;

a fish tail configuration near a stern of the kayak, wherein the fish tail configuration comprises a pair of tail portions that diverge at the stern and converge at a location between the stern and a bow of the kayak to form a single tapered rib on a bottom of the kayak; and a cockpit that is integral with the hull, the cockpit including a seat;

a backrest rotatably connected directly to the body proximate the seat and movable between a substantially vertical orientation and a substantially horizontal orientation, wherein the backrest and body each include a respective element of a hinge mechanism that enables rotation of the backrest; and first and second seat straps, each seat strap connectible to the body and to the backrest.

21. The kayak as recited in claim 20, wherein the backrest is attachable to the body with a snap fit or push fit configuration.

22. The kayak as recited in claim 20, wherein the kayak is stackable with a kayak of substantially similar configuration without necessitating removal of the backrest.

23. The kayak as recited in claim 20, wherein the backrest is detachable from the body of the kayak.

24. The kayak as recited in claim 20, wherein the body is in the form of a sit-on-top configuration.

25. The kayak as recited in claim 20, wherein the cockpit includes a total of three seats.

26. The kayak as recited in claim 20, further comprising a pair of foot wells associated with the seat, each foot well being disposed on a respective opposing side of the cockpit, and wherein the foot wells are positioned lower in the cockpit, relative to an upper surface of the kayak, than the seat.

27. The kayak as recited in claim 26, wherein the first and second seat straps each have a first end releasably connectible to the backrest, and a second end releasably connectible to a bottom of the cockpit at a location inboard of the foot wells.

28. The kayak as recited in claim 20, wherein the body defines a recess within which a portion of the backrest is removably received.

* * * * *